US008696789B2

(12) United States Patent
Mäkelä et al.

(10) Patent No.: US 8,696,789 B2
(45) Date of Patent: Apr. 15, 2014

(54) METHOD FOR PRODUCING FERROALLOY CONTAINING NICKEL

(75) Inventors: Tuomo Mäkelä, Oulu (FI); Pekka Niemelä, Kiviranta (FI)

(73) Assignee: Outokumpu Oyj, Espoo (FI)

( * ) Notice: Subject to any disclaimer, the term of this patent is extended or adjusted under 35 U.S.C. 154(b) by 211 days.

(21) Appl. No.: 13/148,661

(22) PCT Filed: Feb. 11, 2010

(86) PCT No.: PCT/FI2010/050085

§ 371 (c)(1),
(2), (4) Date: Aug. 9, 2011

(87) PCT Pub. No.: WO2010/092234

PCT Pub. Date: Aug. 19, 2010

(65) Prior Publication Data

US 2011/0308352 A1 Dec. 22, 2011

(30) Foreign Application Priority Data

Feb. 11, 2009 (FI) ..... 20090045

(51) Int. Cl.

| | |
|---|---|
| ***C22C 33/04*** | (2006.01) |
| ***C22C 38/08*** | (2006.01) |
| ***C22B 5/00*** | (2006.01) |
| ***C22B 1/14*** | (2006.01) |

(52) U.S. Cl.
USPC ..... 75/430; 75/628; 75/765

(58) Field of Classification Search
USPC ..... 75/765, 430, 628; 420/590
See application file for complete search history.

(56) References Cited

U.S. PATENT DOCUMENTS

| | | | | | |
|---|---|---|---|---|---|
| 2,763,918 | A | * | 9/1956 | Megill | 75/316 |
| 2,772,961 | A | * | 12/1956 | Seger et al. | 75/10.59 |
| 3,847,601 | A | * | 11/1974 | Itoh et al. | 75/316 |
| 3,874,601 | A | | 4/1975 | Swanson, Jr. | |
| 5,567,224 | A | | 10/1996 | Kundrat | |

(Continued)

FOREIGN PATENT DOCUMENTS

| | | | |
|---|---|---|---|
| AU | 644651 | B2 | 12/1993 |
| CN | 1847440 | A * | 10/2006 |

(Continued)

OTHER PUBLICATIONS

Machine translation of CN 1847440, published on Oct. 2006.*

(Continued)

*Primary Examiner* — George Wyszomierski
*Assistant Examiner* — Tima M McGuthry Banks
(74) *Attorney, Agent, or Firm* — Chernoff Vilhauer McClung & Stenzel LLP

(57) ABSTRACT

The invention relates to a method for producing a ferroalloy containing nickel. From a fine-grained raw material containing iron and chromium and a fine-grained raw material containing nickel, a mixture is formed with binding agent, the mixture is agglomerated so that first formed objects of desired size are obtained. The objects formed are heat treated in order to strengthen the objects so that the heat treated objects withstand conveyance and loading into a smelter furnace. Further, the objects are smelted under reducing circumstances in order to achieve ferrochromenickel, a ferroalloy of a desired composition containing at least iron, chromium and nickel.

20 Claims, 1 Drawing Sheet

(56) References Cited

U.S. PATENT DOCUMENTS

| | | | | |
|---|---|---|---|---|
| 5,595,642 | A * | 1/1997 | Xue et al. | 205/591 |
| 5,722,929 | A * | 3/1998 | Smith et al. | 588/257 |
| 8,147,782 | B2 * | 4/2012 | Rishea et al. | 423/139 |
| 2008/0011126 | A1 | 1/2008 | Duarte | |
| 2008/0050294 | A1 * | 2/2008 | Liu et al. | 423/150.1 |

FOREIGN PATENT DOCUMENTS

| | | | |
|---|---|---|---|
| CN | 101092656 | A * | 12/2007 |
| CN | 101469391 | A * | 7/2009 |
| GB | 401644 | * | 2/1932 |
| WO | 9720954 | A1 | 6/1997 |

OTHER PUBLICATIONS

Machine translation of CN 101092656, published on Oct. 2007.*

Derwent Acc No. 2005-170226 for RU 2247169 C1 by Gribanov et al, publkished Feb. 27, 2005. Abstract.* calcine. (n.d.). Dictionary.com Unabridged. Retrieved Apr. 30, 2013, from Dictionary.com website: http://dictionary.reference.com/browse/calcine.*

Ari Hirvonen, International Search Report for PCT/FI2010/050085, Jun. 1, 2010.

* cited by examiner

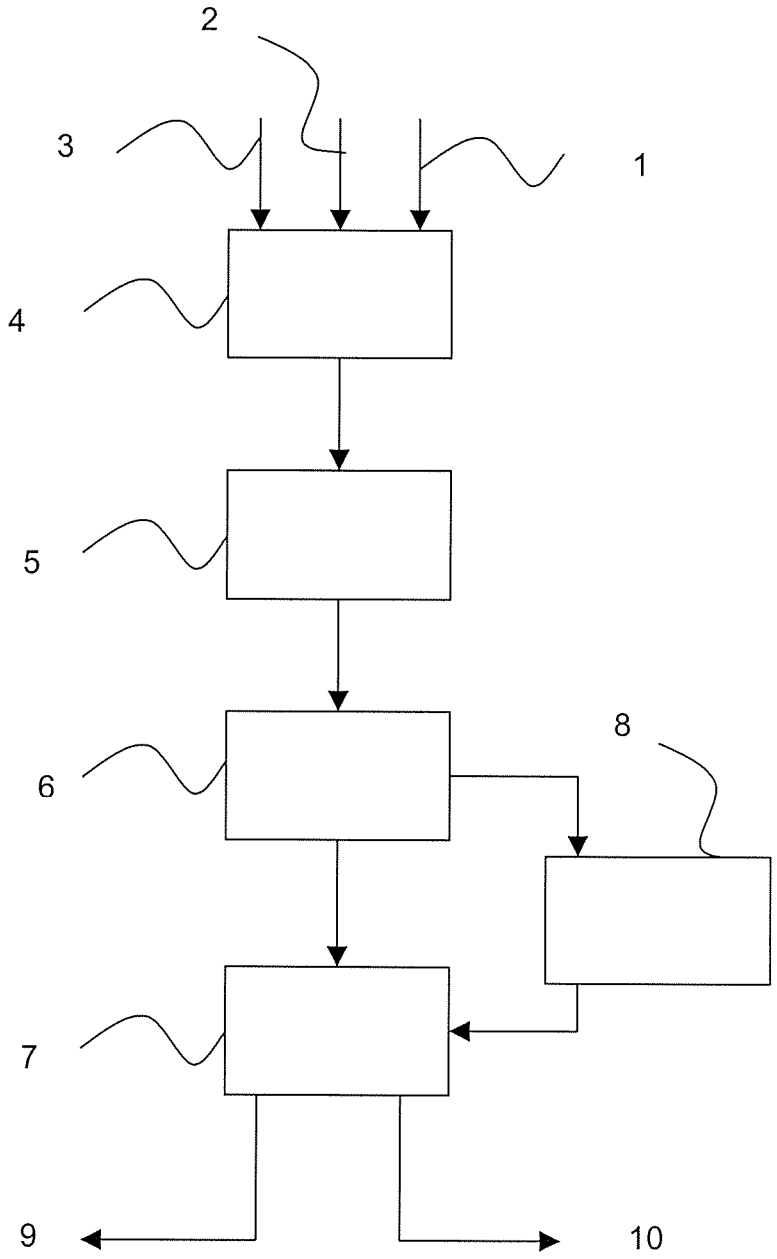
2
3
1
4
5
6
8
7
9
10

METHOD FOR PRODUCING FERROALLOY CONTAINING NICKEL

This is a national stage application filed under 35 USC 371 based on International Application No. PCT/FI2010/050085 filed Feb. 11, 2010, and claims priority under 35 USC 119 of Finnish Patent Application No. FI 20090045, filed Feb. 11, 2009.

This invention relates to a method for producing ferroalloy containing nickel, in which method ferrochromenickel is obtained, used as a raw material for metal, such as stainless steel, when pellets containing iron-bearing chromite concentrate and nickel ore and/or nickel concentrate and/or nickel-bearing intermediate product produced by leaching of nickel ores and/or nickel concentrates and precipitation of the intermediate product from the leach liquor are sintered, and the sintered material is reduced and smelted as ferrochromenickel.

Nickel needed in the production of primary stainless steel is added to the production process normally towards the terminal stage of the production process by adding nickel at the terminal converting stage as stainless steel scrap, as ferronickel, as nickel cathodes received from nickel production or as briquettes containing nickel. Nickel is produced from sulphidic and lateritic ores, the latter ones largely consisting of oxidic laterite ores. The proportion of lateritic ores in the nickel production is strongly increasing. Ferroalloy containing nickel, ferronickel, is produced from primary raw materials under reducing conditions in a rotary kiln/electric furnace process, in which the rotary kiln is used for calcination and prereduction. Impurities remain in ferronickel produced in this fashion, which may necessitate impurity removal treatments. The ferronickel material is cast as castings or is granulated, and the castings or granulation products thus produced are utilized in applications of ferronickel, as in the production of stainless steel.

In addition to the ferronickel production from primary raw materials, from the US patent application 2008/0011126 a method is known for producing ferronickel, wherein a nickel hydroxide intermediate product received from leaching of nickel-bearing ore or concentrate is used as raw material. From the hydroxide intermediate product pellets are formed with a binding agent, pellets are dried at the temperature of 110° C. and fed further into a furnace for calcination at the temperature range of 1000-1300° C. in oxidizing conditions. Moisture contained in pellets is thus removed already at the temperature of 400° C. Further, sulphur contained in pellets is removed as sulphur dioxide or as sulphur trioxide at the temperature of 1100° C. almost totally after the treatment of two hours. Pellets received from the furnace are porous complex nickel iron oxide. These porous complex nickel iron oxide pellets are treated further in the presence of a reducing gas at the temperature range of 800-1000° C. in a packed bed, where pellets are reduced to ferronickel pellets. One embodiment of this US patent application 2008/0011126 is, that the produced ferronickel pellets are smelted and refined to a ferronickel product containing low levels of sulphur and carbon.

WO patent application 97/20954 describes processing of nickel ore and/or nickel concentrate for producing ferronickel, nickeliron and stainless steel via direct smelting. The feed of the smelting process consists of dried and/or calcined sulphidic and/or lateritic nickel ore and/or nickel concentrate, as well as iron ore if required and optionally also chromite as a chromium source. According to the WO patent application 97/20954, pretreatment can be carried out for the material feed in order to remove non-desired material components.

Another pretreatment can include drying and calcination of the material feed in order to remove sulphur and crystalline hydrate water bound in the feed. Calcination can be carried out in a fluidized bed furnace or in a rotary kiln. Products obtained from smelting in reducing conditions are ferronickel, ferrochrome or nickel-bearing iron, which can be further treated in an AOD converter in order to produce stainless steel. Even though according to the WO patent application 97/20954 there is a possibility to feed into the smelting process chromite with dried and calcined nickel ore and/or nickel concentrate, these partial feed material components are fed into the smelting furnace separately as such.

The CA patent 972165 relates to reduced pellets containing iron, chromium and nickel, and the object is to use the pellets to facilitate the production of molten stainless steel. As raw materials the CA patent 972165 mentions nickel silicate ore, chrome iron ore, laterite ore and iron ore. The composition of the essential raw material loading comprises chrome iron ore and run-of-mine nickel silicate ore of variable and low level nickel content. If a high iron concentration in the pellets is desired, iron ore and laterite ore need to be added in the starting composition to provide sufficient iron oxide loading. A reducing agent, coke, is added, the mixture is pelletized, and then the pellets are dried and fired in order to generate reduced pellets. Further, the reduced pellets are hot charged into a submerged arc furnace so as to produce an iron alloy. The composition of iron alloy mentioned in this CA patent 972165 contains 15.2 to 17.7 weight % chromium and 16.3 to 15.8 weight % nickel. Thus the nickel and the chromium contents are of the same order of magnitude. This kind of a material is not directly suitable for the production of stainless steel, because commercial grades of stainless steel contain much more chromium than nickel. When utilizing the product of the CA patent 972165 in stainless steel production, a substantial addition of chrome units is required in the steel melt process in the form of ferrochrome. And the process to which the CA patent 972165 relates to is as such energy intensive per units of metal alloy produced, largely arising from the fact that feed composition is essentially based on run-of-mine nickel silicate ore of low nickel content, which also dictates that large amounts of silicate-oxide slag need to be dealt with and disposed of. The need to top up the metal alloy with chrome units in steel melt, the energy intensity and the metal alloy—slag ratio of the metal alloy production process represent a combination which is not advantageous and is not cost effective for the process of making stainless steel.

The main components in the production of a primary stainless steel, iron and chromium, are obtained for the steel production process from an iron-bearing chrome ore or chrome concentrate, wherefrom ferrochrome is produced by smelting in an electric furnace, preceded by advantageous pelletizing and sintering stages.

As the amount of nickel in stainless steel, when producing so called standardized products, represents up to 10-12 weight % calculated from stainless steel produced as an end product, the parallel production of nickel used in the production of stainless steel is as such not cost-effective or pro-environmental in respect of environmental emissions.

The object of the present invention is to eliminate some drawbacks of the prior art and to achieve a method, where nickel ore and/or nickel concentrate or nickel-bearing intermediate product produced by leaching and precipitation from nickel ores and/or nickel concentrates can be utilized in connection with the production stages, such as pelletizing and sintering, known as such from the production of ferrochrome so as to obtaining as a smelting product nickel containing ferroalloy, ferrochromenickel, which can be used as a raw material for the production of metal, such as stainless steel. The essential features of the invention are enlisted in the attached claims.

According to the invention, nickel ore and/or nickel concentrate or an intermediate product produced by leaching and precipitation from nickel ores and/or nickel concentrates is agglomerated in the production process so as to preparing feed material objects of desired form and size as pellets containing nickel, together with iron and chromium bearing chromite concentrate and a binder, and in such a way that the drying and calcination of the material objects containing nickel, iron and chromium are being carried out and taking place in connection and within one-stage heat treatment of the pellets, known as the sintering process. During the heat treatment of the pellets the objects are strengthened so that it becomes possible to convey the heat treated objects, when desired, in essentially unbroken form between separate process stages. When and if needed, the pellets can be preheated before sintering. Heat treated objects can be conveyed, when desired, in essentially unbroken form between separate process units. The heat treated objects can, when and if desired, be downsized when conveying objects between separate process stages or process units. Sintered and thus strengthened pellets are used as raw material for a smelting process in reducing conditions, in which case a ferroalloy containing nickel is obtained as smelting product, viz. ferrochromenickel. This received ferrochromenickel can be used as a raw material for producing alloyed metal products, such as stainless steel.

Nickel-bearing raw materials to be utilized in the method according to the invention are advantageously nickel-bearing hydroxide intermediate products from mines or other hydrometallurgical processes, which intermediate products are precipitated from leach liquor solutions generated by leach treatment of lateritic and/or sulphidic nickel ores and/or nickel-bearing concentrates or process precipitates of lateritic nickel ores or process precipitates of sulphidic nickel ores. These kinds of nickel-bearing hydroxide intermediate products are for instance intermediate products from pressure leaching, atmospheric leaching or heap leaching of lateritic and/or sulphidic nickel ores and/or nickel concentrates as well as precipitated products of solvent extraction solutions, stripping solutions or refining solutions received from solvent extraction processes or ion exchange processes of nickel-bearing materials. In the method of the invention also carbonate or sulphate nickel materials can be used as a raw material. Further, hydrometallurgically precipitated nickel sulphide intermediate products are also applicable as raw material for the method.

In the method of the invention nickel-containing fine-ground material is first mixed with a fine-ground iron-containing chromite concentrate and a desired binder. The proportion of the nickel-bearing material in the mixture is 10-25 weight %, advantageously 15-20 weight % of the weight of the mixture. Pellets having a diameter of 5-15 mm are advantageously formed from this mixture with a binder. The pellets thus formed are further conveyed into oxidizing sintering, where pellets are heated to the temperature range of 1150-1400° C. by means of hot circulating gas, carbon included in pellets and, if needed, supported by other fuels, such as propane. In connection with the sintering process nickel-containing material objects are made to be calcined, as well as sulphur included in pellets is made to be removed to the exhaust gases of the sintering process, which gases are cleaned in a gas scrubbing device. The strength properties of sintered pellets are sufficient to endure required further processing. The pellets contain nickel raw material in a calcined form, and the pellets are further conveyed advantageously through a preheating unit into an electric furnace, where smelting takes place under reducing conditions. The smelting product thus generated is metallic ferrochromenickel having the ratio of chromium to nickel between 1.5 and 5, advantageously between 2.0 and 3.1. Ferrochromenickel thus generated and received from the electric furnace is conveyed advantageously in smelted state further to be used in the production of stainless steel. The smelted ferrochromenickel received from the electric furnace can also be granulated into solid form making use of the thus generated granulation product further in the production of stainless steel. As such, ferrochromenickel received from an electric furnace either in smelted state or in granulated product can be used also for some other end products, where raw material containing at least iron, chrome and nickel is needed.

The method according to the invention is energy efficient, because the pellet mixture formed of nickel containing material and iron containing chromite concentrate can be simultaneously calcined and desulphurized in connection and within the sintering process. Thus pellets of good reductibility characteristics are obtained from sintering, which as such further helps smelting under reducing conditions. Further, by using preheating of pellets to be conveyed into smelting, the use of electricity per product unit is diminished in a smelting furnace used for smelting. Further, when reduction and smelting of pellets are carried out advantageously in a closed submerged electric arc furnace, carbon monoxide gases created in reduction and smelting can be utilized, on the one hand for instance in sintering and in a possible preheating of pellets, and on the other hand for instance in sequential stages of the production chain for stainless steel produced from the ferroalloy smelting product, ferrochromenickel.

The energy efficiency of the method according to the invention is also enhanced by the fact that nickel included in pellets catalyzes the reduction of chromium in pellets and thus diminishes specific consumption of the reducing agent, advantageously carbon, in ferroalloy production.

Whatever as such known pelletizing method can be used for the pelletizing of the raw material in the method according to the invention, advantageously for instance pelletizing in a drum. Instead of pelletizing, for instance briquetting can be used, or a corresponding method which facilitates that the raw material mixture according to the invention can be treated in the ensuing process stages.

According to the invention, sintering can be carried out by whatever as such known sintering method, advantageously for instance by the essentially continuously operated belt sintering. Sintering can be replaced also by another as such known heating treatment, the product of which must be easily further treatable in order to achieve the final product of the method in accordance with the invention, viz ferrochromenickel.

The smelting of the material to be treated in accordance with the invention is advantageously carried out using an electric furnace, such as a submerged electric arc furnace. Smelting can also be carried out by other known smelting arrangements, such as an induction furnace, where it is possible to achieve reducing conditions for producing the desired final product, ferrochromenickel.

The invention is described in more details in the following referring to the enclosed drawing, where FIG. 1 shows one preferred embodiment of the invention as a schematic flow sheet.

According to FIG. 1 a fine-ground iron containing chromite concentrate 1, a fine-ground nickel hydroxide 2 and a binder 3 for pelletizing is fed into a mixing apparatus 4 so that the proportion of the fine-ground nickel material 2 from the mixture to be received from the mixing apparatus 4 is 18 weight % from the weight of the mixture. The mixture thus generated, containing iron, chromium and nickel is conveyed to a rotating drum 5 for pelletizing. The pellets to be received from the drum 5 are further conveyed to an essentially continuously operated belt sintering 6, for which purpose an essentially uniform material bed of pellets is laid out on the essentially continuously operated sintering belt. In the sintering stage, hot circulation gases are conducted through the material bed and the sintering belt, and by means of these gases and some extra fuel the temperature in the material is made to rise to the range of 1150-1400° C.

During the sintering stage, moisture is removed from the pellets, as well as the nickel hydroxide is advantageously calcined, thus providing removal of water from the nickel hydroxide as well as of crystalline hydrate water bound therein. During the sintering stage, sulphur bound in various components is removed from the mixture. The sintered pellets are further conveyed into smelting together with the slag forming agent and the reducing agent in a submerged electric arc furnace 7 either through a preheating 8 or directly without preheating. The molten ferrochromenickel to be received from the smelting furnace 7 is conveyed into a steel smelter 9 for producing stainless steel or the molten ferrochromenickel is granulated for further processing.

EXAMPLE 1

The method according to the invention was applied to a material in which nickel hydroxide intermediate product was present as sulphate nickel hydroxide $Ni(OH)_x(SO_4)_y$, received from a leaching process by precipitation, with nickel content in the range of 40-50 weight % and sulphur content below 5 weight %. The chromium content in the chromite concentrate used as a raw material for chromium and iron varied between 30-31 weight % and the chromium/iron ratio in the concentrate between 1.6-1.8.

The sulphate nickel hydroxide was mixed with the chromite concentrate and bentonite used as a binder so that the proportion of the sulphate nickel hydroxide in the mixture was 20 weight % calculated from the final weight of the mixture. The mixture was fed into a rotating drum, where pellets with a diameter between 5-15 mm were formed from the mixture. The pellets received from the drum were further fed onto the sintering belt of the essentially continuously operated belt sintering as essentially evenly spread pellet bed. During sintering hot gases were conducted through the pellet bed as well as also through the holes in the sintering belt and when and if needed, applying other sources of energy so as to calcine sulphate nickel hydroxide and to remove sulphur contained in the sulphate nickel hydroxide into the exhaust gases of sintering, which gases can be treated for the removal of sulphur dioxide by as such known methods. The strength properties of the sintered pellets corresponded to the abrasion resistance of the chromite pellets, tumbler 3-5%, and the compression strength 140-160 kg/cm$^2$.

Together with coke used as a reducing agent, quartzite used as a slag forming agent and lumpy chromite used as a regulation agent for achieving the desired chromium and iron content in the smelting product, the pellets received from sintering were fed first into a preheating unit of the smelting furnace and therefrom into the smelting furnace itself. The smelting product received, ferrochromenickel, was granulated and contained 40-45 weight % chromium, 18-24 weight % nickel and 3-5 weight % carbon, the rest being iron and inevitable impurities.

EXAMPLE 2

The pelletizing and sintering properties of the same intermediate product material described in the example 1 were tested in accordance with the method of the invention by mixing different amounts of the intermediate product material with a chromite concentrate. The amounts of the intermediate product material were 10 weight %, 15 weight % 20 weight % calculated from the weight of the mixtures. The mixtures also contained bentonite and limestone or wollastonite, a calcium silicate, as binder agents.

The mixtures containing chromite concentrate, nickel hydroxide and the binder agent were fed to the pelletizing drum in order to create pellets having a diameter of 5-15 mm. The pellets were further fed onto a sintering belt where the pellets were sintered in a belt sintering machine. The sintered pellets were tested using the modified Tumbler method and other established industry standard methodologies regarding abrasion resistance, compressive strength, hot loading temperature, porosity, chemical composition and microstructures.

The Tumbler method gave similar values for the sintered pellets with 10 weight % nickel hydroxide as the pure chromite pellets. At the level of 20 weight % nickel hydroxide in the mixture, the abrasion resistance of pellets was degraded, although the compression strength was fairly high and abrasion resistance was improved when wollastonite was used instead of limestone. The Tumbler value for the addition of 20 weight % nickel hydroxide was high, because the porosity of the pellets was high. The porosity with 20 weight % nickel hydroxide was higher than the porosity with 15 weight % nickel hydroxide. However, the compression strength of the pellets with 15 weight % nickel hydroxide was high enough for further processing in the smelting furnace. Thus all the pellets generated from the mixtures having 10 weight % 15 weight % or 20 weight % nickel hydroxide as a nickel-bearing intermediate product were acceptable for the smelting in a smelting furnace in order to produce ferrochromenickel. The pellets based on the mixtures having originally 10 weight %, 15 weight % or 20 weight % nickel hydroxide were separately smelted for ferrochromenickel and further granulated. The ratios of chromium to nickel in ferrochromenickel based on each mixture were the following: 4.8 for the mixture having originally 10 weight % nickel hydroxide, 3.05 for the mixture having originally 15 weight % nickel hydroxide and 2.1 for the mixture having originally 20 weight % nickel hydroxide.

The invention claimed is:

1. A method for producing a nickel containing ferroalloy, comprising:

forming a mixture of a raw material containing iron and chromium, a raw material containing nickel, and a binder material, agglomerating the mixture to form objects having a desired size, heat-treating the objects at a temperature sufficient for removal of water of crystallization bound in the raw material, whereby the raw material containing nickel is calcinated and the objects are strengthened so that the heat-treated objects are conveyable, and smelting the objects under reducing conditions in order to produce ferrochromenickel containing chromium and nickel in a ratio between 1.5 and 5, and wherein the raw material containing iron and chromium supplies substantially all the iron and chromium in the ferrochromenickel; and wherein the raw material containing iron and chromium comprises chromite concentrate.

2. A method for producing a nickel containing ferroalloy, comprising:

forming a mixture of a raw material containing iron and chromium, a raw material containing nickel, and a binder material, agglomerating the mixture to form objects having a desired size, heat-treating the objects at a temperature sufficient for removal of water of crystallization bound in the raw material, whereby the raw material containing nickel is calcinated and the objects are strengthened so that the heat-treated objects are conveyable, and smelting the objects under reducing conditions in order to produce ferrochromenickel containing chromium and nickel in a ratio between 1.5 and 5, and wherein the raw material containing iron and chromium supplies substantially all the iron and chromium in the ferrochromenickel; and wherein the raw material containing nickel comprises a nickel-bearing hydroxide intermediate product precipitated from leach liquors of hydrometallurgical processes of a nickel precourser selected from a group consisting of lateritic nickel ores, nickel-bearing concentrates, and process precipitates of lateritic nickel ores.

3. A method according to claim 2, wherein the raw material containing nickel comprises an intermediate product from pressure leaching of a nickel precourser selected from a group consisting of lateritic nickel ores, nickel-bearing concentrates, and process precipitates of lateritic nickel ores.

4. A method according to claim 2, wherein the raw material containing nickel comprises an intermediate product from atmospheric leaching of a nickel precourser selected from a group consisting of lateritic nickel ores, nickel-bearing concentrate, and process precipitates of lateritic nickel ores.

5. A method according to claim 2, wherein the raw material containing nickel comprises an intermediate product from heap leaching of a nickel precourser selected from a group consisting of lateritic nickel ores, nickel-bearing concentrates, and process precipitates of lateritic nickel ores.

6. A method according to claim 2, wherein the raw material containing nickel comprises an intermediate product from a solvent extraction process of a nickel precourser selected from a group consisting of lateritic nickel ores, nickel-bearing concentrates, and process precipitates of lateritic nickel ores.

7. A method according to claim 2, wherein the raw material containing nickel comprises an intermediate product received from an ion exchange process of a nickel precourser selected from a group consisting of lateritic nickel ores, nickel-bearing concentrates, and process precipitates of lateritic nickel ores.

8. A method according to claim 2, wherein the raw material containing nickel comprises an intermediate product received from a refining process of a nickel precourser selected from a group consisting of lateritic nickel ores, nickel-bearing concentrates, and process precipitates of lateritic nickel ores.

9. A method for producing a nickel containing ferroalloy, comprising:

forming a mixture of a raw material containing iron and chromium, a raw material containing nickel, and a binder material, agglomerating the mixture to form objects having a desired size, heat-treating the objects at a temperature sufficient for removal of water of crystallization bound in the raw material, whereby the raw material containing nickel is calcinated and the objects are strengthened so that the heat-treated objects are conveyable, and smelting the objects under reducing conditions in order to produce ferrochromenickel containing chromium and nickel in a ratio between 1.5 and 5, and wherein the raw material containing iron and chromium supplies substantially all the iron and chromium in the ferrochromenickel; and wherein the raw material containing nickel comprises a nickel-bearing hydroxide intermediate product precipitated from leach liquors from a nickel precourser selected from a group consisting of hydrometallurgical processes of sulfidic nickel ores, nickel-bearing concentrates, and process precipitates of sulfidic ores.

10. A method according to claim 9, wherein the raw material containing nickel comprises an intermediate product received from the pressure leaching of a nickel precourser selected from a group consisting of sulfidic nickel ores, nickel-bearing concentrates, and process precipitates of sulfidic ores.

11. A method according to claim 9, wherein the raw material containing nickel comprises intermediate products received from the atmospheric leaching of a nickel precourser selected from a group consisting of sulfidic nickel ores, nickel-bearing concentrates, and process precipitates of sulfidic ores.

12. A method according to claim 9, wherein the raw material containing nickel comprises intermediate products received from the heap leaching of a nickel precourser selected from a group consisting of sulfidic nickel ores, nickel-bearing concentrates, and process precipitates of sulfidic ores.

13. A method according to claim 9, wherein the raw material containing nickel comprises intermediate products received from the solvent extraction process of a nickel precourser selected from a group consisting of sulfidic nickel ores, nickel-bearing concentrates , and process precipitates of sulfidic ores.

14. A method according to claim 9, wherein the raw material containing nickel comprises intermediate products received from the ion exchange process of a nickel precourser selected from a group consisting of sulfidic nickel ores, nickel-bearing concentrates , and process precipitates of sulfidic ores.

15. A method according to claim 9, wherein the raw material containing nickel comprises intermediate products received from the refining process of a nickel precourser selected from a group consisting of sulfidic nickel ores , nickel-bearing concentrates , and process precipitates of sulfidic ores.

16. A method for producing a nickel containing ferroalloy, comprising:

forming a mixture of a raw material containing iron and chromium, a raw material containing nickel, and a binder material, agglomerating the mixture to form objects having a desired size, heat-treating the objects at a temperature sufficient for removal of water of crystallization bound in the raw material, whereby the raw material containing nickel is calcinated and the objects are strengthened so that the heat-treated objects are conveyable, and smelting the objects under reducing conditions in order to produce ferrochromenickel containing chromium and nickel in a ratio between 1.5 and 5, and wherein the raw material containing iron and chromium supplies substantially all the iron and chromium in the ferrochromenickel; and wherein the raw material containing nickel comprises carbonate nickel materials.

17. A method for producing a nickel containing ferroalloy, comprising:

forming a mixture of a raw material containing iron and chromium, a raw material containing nickel, and a binder material, agglomerating the mixture to form objects having a desired size, heat-treating the objects at a temperature sufficient for removal of water of crystallization bound in the raw material, whereby the raw material containing nickel is calcinated and the objects are strengthened so that the heat-treated objects are conveyable, and smelting the objects under reducing conditions in order to produce ferrochromenickel containing chromium and nickel in a ratio between 1.5 and 5, and wherein the raw material containing iron and chromium supplies substantially all the iron and chromium in the ferrochromenickel; and wherein the raw material containing nickel comprises sulfate nickel materials.

18. A method for producing a nickel containing ferroalloy, comprising:

forming a mixture of a raw material containing iron and chromium, a raw material containing nickel, and a binder material, agglomerating the mixture to form objects having a desired size, heat-treating the objects at a temperature sufficient for removal of water of crystallization bound in the raw material, whereby the raw material containing nickel is calcinated and the objects are strengthened so that the heat-treated objects are conveyable, and smelting the objects under reducing conditions in order to produce ferrochromenickel containing chromium and nickel in a ratio between 1.5 and 5, and wherein the raw material containing iron and chromium supplies substantially all the iron and chromium in the ferrochromenickel; and wherein the raw material containing nickel comprises sulfidic nickel materials.

19. A method for producing a nickel containing ferroalloy, comprising:

forming a mixture of a raw material containing iron and chromium, a raw material containing nickel, and a binder material, agglomerating the mixture to form objects having a desired size, heat-treating the objects at a temperature sufficient for removal of water of crystallization bound in the raw material, whereby the raw material containing nickel is calcinated and the objects are strengthened so that the heat-treated objects are conveyable, and smelting the objects under reducing conditions in order to produce ferrochromenickel containing chromium and nickel in a ratio between 1.5 and 5, and wherein the raw material containing iron and chromium supplies substantially all the iron and chromium in the ferrochromenickel; and wherein at least one component of the mixture comprises sulfur bound therein and the method comprises removing sulfur from the mixture.

20. A method for producing a nickel containing ferroalloy, comprising:

forming a mixture of a raw material containing iron and chromium, a raw material containing nickel, and a binder material, agglomerating the mixture to form objects having a desired size, heat-treating the objects at a temperature sufficient for removal of water of crystallization bound in the raw material, whereby the raw material containing nickel is calcinated and the objects are strengthened so that the heat-treated objects are conveyable, and smelting the objects under reducing conditions in order to produce ferrochromenickel containing chromium and nickel in a ratio between 1.5 and 5, and wherein the raw material containing iron and chromium supplies substantially all the iron and chromium in the ferrochromenickel; and wherein the agglomerated and smelted ferrochromenickel contains 40-45 weight % chromium, 18-24 weight % nickel, 3-5 weight % carbon, the rest iron and inevitable impurities.

* * * * *